US012352171B2

(12) United States Patent
Negre et al.

(10) Patent No.: US 12,352,171 B2
(45) Date of Patent: Jul. 8, 2025

(54) COMPRESSED-AIR ENGINE WITH INTEGRATED ACTIVE CHAMBER AND ACTIVE DISTRIBUTION WITH BALANCED VALVE

(71) Applicant: MOTOR DEVELOPMENT INTERNATIONAL S.A., Luxembourg (LU)

(72) Inventors: Cyril Negre, Nice (FR); Christophe Hurth, Nice (FR)

(73) Assignee: MOTOR DEVELOPMENT INTERNATIONAL SA, Luxembourg (LU)

( * ) Notice: Subject to any disclaimer, the term of this patent is extended or adjusted under 35 U.S.C. 154(b) by 71 days.

(21) Appl. No.: 18/252,506

(22) PCT Filed: Nov. 11, 2020

(86) PCT No.: PCT/EP2020/025509
§ 371 (c)(1),
(2) Date: May 10, 2023

(87) PCT Pub. No.: WO2022/100810
PCT Pub. Date: May 19, 2022

(65) Prior Publication Data
US 2023/0407747 A1 Dec. 21, 2023

(51) Int. Cl.
*F01B 17/02* (2006.01)
*F01B 25/10* (2006.01)
(Continued)

(52) U.S. Cl.
CPC ..... *F01B 17/02* (2013.01); *F01B 25/10* (2013.01); *F01L 1/146* (2013.01); *F01L 1/181* (2013.01); *F01L 9/16* (2021.01); *F01L 2003/258* (2013.01)

(58) Field of Classification Search
CPC ..... F01B 17/025; F01B 25/10; F01B 17/02; F01L 9/16; F01L 2003/258; F01L 1/181; F01L 1/182; F01L 3/20; F02B 21/00
See application file for complete search history.

(56) References Cited

U.S. PATENT DOCUMENTS 896,439 A * 8/1908 Oriner ..... F01L 1/465 123/90.14
3,410,304 A * 11/1968 Paul, Jr. ..... F16K 17/042 251/63.4
(Continued)

FOREIGN PATENT DOCUMENTS

DE 1042607 B * 11/1958 ..... F01L 9/16
DE 102011078556 B3 * 11/2012 ..... F01L 1/30
(Continued)

OTHER PUBLICATIONS

WO-2015177076-A2, English Language Machine Translation (Year: 2015).*
(Continued)

*Primary Examiner* — Wesley G Harris
(74) *Attorney, Agent, or Firm* — NIXON & VANDERHYE

(57) ABSTRACT

Disclosed is an active chamber engine including a cylinder fed with compressed air, a piston, a cylinder head which includes an intake duct, an intake orifice, an intake valve, wherein the volume of the cylinder is divided into an included active chamber and an expansion chamber and the torque and the speed of the engine are controlled by the opening and closing of the intake valve characterized in that the intake valve moves in the direction opposite to the flow direction of the pressurized gas stream in its opening direction and is held closed on a seat by a return spring in its closing position, and that the axial forces acting on the
(Continued)

intake valve resulting from the pressure in the intake duct and in the cylinder are permanently balanced.

17 Claims, 9 Drawing Sheets

(51) Int. Cl.

| | |
|---|---|
| ***F01L 1/14*** | (2006.01) |
| ***F01L 1/18*** | (2006.01) |
| ***F01L 9/16*** | (2021.01) |
| *F01L 3/00* | (2006.01) |

(56) References Cited

U.S. PATENT DOCUMENTS

| | | | | |
|---|---|---|---|---|
| 5,193,495 | A * | 3/1993 | Wood, III | F01L 9/16 123/90.15 |
| 2008/0251041 | A1* | 10/2008 | Lou | F01L 9/16 123/90.12 |
| 2009/0044778 | A1* | 2/2009 | Scuderi | F01L 1/38 123/188.2 |

FOREIGN PATENT DOCUMENTS

| | | | | |
|---|---|---|---|---|
| EP | 2063075 | A1 * | 5/2009 | F01L 9/10 |
| FR | 3021347 | A1 * | 11/2015 | F01B 17/00 |
| GB | 2212857 | A * | 8/1989 | F01L 1/12 |
| GB | 2291126 | A * | 1/1996 | F01L 13/06 |
| WO | 03036088 | A1 | 5/2003 | |
| WO | 03089764 | A1 | 10/2003 | |
| WO | 2005049968 | A1 | 6/2005 | |
| WO | 2008028881 | A1 | 3/2008 | |
| WO | 2012045693 | A1 | 4/2012 | |
| WO | 2012045694 | A1 | 4/2012 | |
| WO | WO-2015177076 | A2 * | 11/2015 | F01B 17/00 |

OTHER PUBLICATIONS

International Search Report for PCT/EP2020/025509 mailed Jul. 30, 2021, 6 pages.

Written Opinion of the ISA for PCT/EP2020/025509 mailed Jul. 30, 2021, 5 pages.

* cited by examiner

COMPRESSED-AIR ENGINE WITH INTEGRATED ACTIVE CHAMBER AND ACTIVE DISTRIBUTION WITH BALANCED VALVE

CROSS-REFERENCE TO RELATED APPLICATIONS

This application is the U.S. national phase of International Application No. PCT/EP2020/025509 filed Nov. 11, 2020, which designated the U.S., the entire contents of which are hereby incorporated by reference.

TECHNICAL FIELD OF THE INVENTION

The invention concerns an engine operating in particular with compressed air, or any other gas, and using a chamber known as the "active chamber".

The invention relates to the intake distribution of such an engine, and more particularly to an engine with an enclosed active chamber, and in particular to a multi-modal auto-expander engine with an enclosed active chamber.

TECHNICAL BACKGROUND

The means used to feed such an engine with compressed gas is called distribution.

The inventors and/or the applicant have filed numerous patents concerning motorizations and their installations, using gases and more particularly compressed air for a totally clean operation in urban and suburban areas.

In particular, they have filed an international patent application WO-A1-03/036088, the contents of which may be referred to, concerning a motor-compressor-generator unit with additional compressed air injection that can operate in a so-called single-energy mode, and in a so-called multi-energy mode.

In these types of compressed air engines with a compressed air storage tank, it is necessary to expand the compressed air stored at a very high pressure in the tank—but whose pressure decreases as the tank is emptied—to a stable intermediate pressure, the so-called final operating pressure, in a buffer capacity—the so-called working capacity—before it is used in the engine's power cylinder(s).

In order to solve the problems of the pressure reducer, the inventors and/or the applicant have also filed a patent application WO-A1-03/089764, to the contents of which reference may be made, concerning a dynamic variable flow rate pressure reducer and a distribution for engines fed with compressed air injection, comprising a high-pressure compressed air reservoir and a working capacity.

In the operation of these "charge expansion" engines, the filling of the expansion chamber always represents a workless expansion that is detrimental to the overall efficiency of the machine.

To solve the above problem, the inventors and/or the applicant then filed a patent application WO-A1-2005/049968 describing a compressed air engine fed preferably with compressed air, or by any other compressed gas, contained in a high-pressure storage tank, previously expanded to a nominal working pressure in a buffer capacity called working capacity.

In this type of engine according to the teachings of document WO-A1-2005/049968:

- the expansion chamber is constituted by a variable volume equipped with means for producing work, it is twinned and in contact by a permanent passage with the space above the main engine piston which is equipped with a device for stopping the piston at its top dead centre;
- during the stopping of the stroke of the driving piston at its top dead centre, air or gas under pressure is admitted into the expansion chamber when the latter is at its smallest volume and, under thrust, will increase its volume by producing work;
- with the expansion chamber maintained at substantially its maximum volume, the compressed air contained therein then expands into the engine cylinder, thus pushing the engine piston in its downward stroke, in turn producing work;
- during the upstroke of the engine piston during the exhaust stroke, the variable volume of the expansion chamber is reduced to its smallest volume in order to start a complete working cycle again.

The expansion chamber of the engine according to this invention actively participates in the work. The engine is thus called an "active chamber" engine.

In particular, document WO-A1-2005/049968 teaches a four-phase thermodynamic cycle during its operation in single-energy compressed air mode characterized by:

- an isothermal expansion without work;
- a transfer—light expansion with work called quasi-isothermal;
- a polytropic expansion with work;
- an exhaust at ambient pressure.

Document WO-A1-2008/028881, which presents a variant of the teachings of document WO-A1-2005/049968, teaches the same thermodynamic cycle, but using a known and conventional motion transformation device of the rod and crank type, with the expansion chamber of the engine according to the invention actively participating in the work.

The engines according to the teachings of WO-A1-2005/049968 and WO-A1-2008/028881 are called "active chamber engines".

Subsequently, the inventors and/or applicant filed a patent application for an air or compressed gas engine with an included active chamber which implements the same thermodynamic cycle as the engines according to the teachings of WO-A1-2005/049968 and WO-A1-2008/028881, as well as a conventional crank-crank arrangement.

According to the teachings of document—WOA12012/045693—, the inventors proposed an engine with an included active chamber, comprising at least one piston slidably mounted in a cylinder and driving a crankshaft by means of a traditional connecting rod and crank device and operating according to a four-phase thermodynamic cycle comprising:

- an isothermal expansion without work;
- a transfer—a slight expansion with work called quasi-isothermal;
- a polytropic expansion with work;
- an exhaust at ambient pressure.

Fed preferably by compressed air, or any other compressed gas, contained in a high-pressure storage tank, through a buffer capacity called working capacity which is fed by compressed air, or any other compressed gas, contained in a high-pressure storage tank, which is expanded to a medium pressure called working pressure in a working capacity preferably through a dynamic expansion device, in which:

- the active chamber is included/incorporated in the power cylinder;
- the power cylinder comprises at least one piston slidably mounted in at least one cylinder whose volume swept by the piston is divided into two distinct parts, a first part of which constitutes the active chamber CA and a second part of which constitutes the expansion chamber CD;

the cylinder is closed at its upper part by a cylinder head comprising at least one duct and one intake orifice, and at least one duct and one exhaust orifice and which is arranged in such a way that, when the piston is at its top dead centre, the residual volume between the piston and the cylinder head is, by construction, if not non-existent, reduced to the minimum clearances allowing operation without contact between the piston and the cylinder head;

the compressed air or gas under pressure is admitted into the cylinder above the piston when the volume of the active chamber CA is at its smallest and which, under the continuous thrust of the compressed air at constant working pressure, will increase its volume by producing work representing the quasi-isothermal transfer phase;

the admission of the compressed air, or of the gas under pressure, into the cylinder is closed as soon as the maximum volume of the active chamber CA is reached, and the quantity of compressed air, or of the gas under pressure, contained in the said active chamber then expands by pushing the piston back over the second part of its stroke which determines the expansion chamber CD by producing work thus ensuring the expansion phase;

the piston having reached its bottom dead centre, the exhaust orifice is then opened to ensure the exhaust phase during the upstroke of the piston over its entire stroke.

The volume of the included active chamber CA and the volume of the expansion chamber CD are dimensioned in such a way that at the nominal operating pressure of the engine, the pressure at the end of the expansion at bottom dead centre is close to the ambient pressure, in particular atmospheric pressure. The volume of the active chamber is determined by the closing of the intake.

Advantageously, and in particular in single-energy compressed air operation, the enclosed active chamber engine described above comprises several successive cylinders of increasing displacement.

Preferably, the engine is fed, as in the teachings of WO-A1-2005/049968 and WO-A1-2008/028881, with compressed air, or any other compressed gas, contained in a high-pressure storage tank, previously expanded, at a nominal working pressure, into a buffer capacity—the so-called working capacity.

However, even if it is possible in the case of a multi-stage engine to feed the first of the cylinders at high pressures, it is still necessary to expand the very high pressure compressed air contained in the high pressure storage tank to a nominal working pressure and this expansion operation either leads to a loss of efficiency by using a conventional expansion valve or, with the use of the teachings of WO-A1-03/089764, does not cost energy, but this expansion does not allow any expansion work to be carried out between the high pressure contained in the tank and the nominal working pressure in the constant volume working capacity.

The inventors and/or the applicant then filed a new patent application WO-A1-2012/045694, to the contents of which reference may be made, which claims a compressed air engine with an included active chamber in which: —the storage tank for high-pressure compressed air, or any other gas under pressure, feeds directly into the intake of the engine cylinder;

the filling of the enclosed active chamber CA is carried out at a constant intake pressure at each engine revolution, this intake pressure being degressive as the pressure in the storage tank decreases as this tank is progressively emptied;

the volume of the included active chamber CA is variable and is progressively increased as the pressure in the storage tank decreases, which determines said intake pressure;

the means for opening and closing the intake of compressed air into the included active chamber CA not only make it possible to open the intake orifice and duct substantially at the top dead centre of the piston stroke, but also make it possible to modify the duration and/or the angular sector of the intake, as well as the cross-sectional area of the opening;

the volume of the included active chamber CA is dimensioned for the maximum storage pressure, then it is progressively increased in such a way that, depending on the intake pressure, the volume ratio between the included active chamber CA and the expansion chamber CD, the pressure at the end of the expansion before the opening of the exhaust is close to the atmospheric pressure.

The engine according to WO-A1-2012/045694 also acts as a pressure reducer, the invention thus making it possible to offer a so-called "self-expanding" engine that, for the feed of the active chamber CA, does not require an independent pressure reducer of any type.

The multi-modal auto-expander engine with active chamber included according to the teachings of document WO-A1-2012/045694 implements in particular, during its operation in compressed air single energy mode, a three-phase thermodynamic cycle comprising:

an isobaric and isothermal transfer phase a polytropic expansion phase with work an exhaust phase at ambient pressure.

In the operation of this engine, the volume of the enclosed active chamber, which varies according to the pressure of the high-pressure storage tank, determines the amount of compressed air injected. The higher the intake pressure, the smaller the volume of the active chamber must be.

In order to obtain correct operation in all phases of the engine's use, it is therefore necessary to feed it with a high degree of precision according to the various parameters, in particular the speed or rpm, the feed pressure, the load determined by the position of the accelerator, the temperature.

For this purpose, it is necessary to be able to vary:

the moment of opening of the intake depending on the engine rotation speed before or after the top dead centre to take into account the inertia of the gases, but also the ratio between the times of establishment of the pressure, the moment of closing of the intake, depending on the engine rotation speed, but also on the intake pressure, the lift of the intake valve depending on the desired load.

The difficulty lies in the design of the means of opening and closing the compressed air intake into the included working chamber, which not only allow the opening of the intake orifice and duct substantially at the top dead centre of the piston stroke, but also allow the duration and/or angular sector of the intake to be modified, as well as the cross-section of the opening.

All types of engines are usually equipped with valves, the operation of which is well known.

Thus, a valve closes the intake and/or exhaust duct and comprises a valve head held by a spring or springs supported on a circular valve seat formed around an orifice putting the intake and/or exhaust duct in communication with the combustion and/or expansion chamber contained in the cylinder.

The valve head opens the circuit by entering the chamber to be fed, driven by mechanical cam and tappet systems acting on the valve stem which extends the valve head.

In other areas of motorisation and for other technical reasons, particularly concerning the reduction of pollution and in order to control the intake and exhaust of conventional combustion engines, a large number of engine manufacturers are working on systems to control the phasing and duration of valve openings during operation and have filed numerous patents concerning these applications. Complex mechanical systems driven by electric stepper motors have also been developed and marketed, notably by BMW (Trademark) with the so-called "Vamos" device.

The inventors and/or the applicant have also filed patent application WO-A1-03/089764, the contents of which may be referred to, concerning a progressively controlled valve.

A great deal of work has been done on electromechanical devices, in particular those controlled by electromagnets that can be easily piloted to take into account the various operating parameters, but the electrical power that must be used to allow the accelerations and the speed of movement of the valves requires considerable power, given the weight and inertia of the latter.

In order to solve the above-mentioned problems while providing additional power, the inventors and/or applicant have filed patent application WO-A2-2015/177076 for a compressed air engine with an included active chamber and active intake manifold.

The active intake distribution device according to this document applied to compressed air engines uses the compressed air contained in the high-pressure storage tank and/or in the intake circuit to move the intake valve in order to open and then close the intake conduit to feed the active chamber of the engine, the compressed air used for these actions being then reused in the engine to produce additional work.

An active chamber engine operating according to a three-phase thermodynamic cycle has been proposed, comprising:

an isobaric and isothermal transfer phase;

an isobaric and isothermal transfer phase;

a polytropic expansion phase with work;

an exhaust phase at ambient pressure;

this engine comprising:

at least one cylinder fed with a gas under pressure, preferably compressed air, contained in a high-pressure storage tank, at least one piston which is slidably mounted in this cylinder, a crankshaft driven by the piston by means of a conventional rod and crank mechanism, a cylinder head which closes off the volume of the cylinder at its upper part, which is swept by the piston, and which comprises at least one intake duct into which flows a flow of gas under pressure for filling the cylinder, a gas under pressure intake opening above the piston, and at least one exhaust opening and one exhaust duct, the cylinder head being arranged in such a way that, when the piston is at its top dead centre, the residual volume between the piston and the cylinder head is structurally reduced only to the minimum clearances permitting non-contact operation between the piston and the cylinder head, at least one intake valve which cooperates in a sealing manner with a valve seat formed in the cylinder head and which delimits the intake opening, wherein:

the volume of the cylinder swept by the piston is divided into two distinct parts of which a first part constitutes an active chamber which is included in the cylinder and a second part constitutes an expansion chamber, under the continuous thrust of the gas under pressure admitted into the cylinder, at constant working pressure, the volume of the active chamber increases by producing work representing the isobaric and isothermal transfer phase, the admission of the gas under pressure into the cylinder is closed as soon as the maximum volume of the active chamber is reached, the quantity of gas under pressure included in the said active chamber then expands by pushing the piston back over the second part of its stroke which determines the expansion chamber, producing work thus ensuring the polytropic expansion phase, the piston having reached its bottom dead centre, the exhaust orifice is then opened to ensure the exhaust phase during the piston's upstroke over its entire stroke to its top dead centre, the engine's torque and speed are controlled by opening and closing the intake valve by allowing the intake valve to open, substantially at the top dead centre of the piston's stroke, and by allowing, by closing the valve, the duration and/or the angular sector of the intake as well as the passage cross-section of the intake opening to be changed in order, depending on the pressure of the compressed gas contained in the storage tank and the pressure at the end of the expansion phase, to determine the quantity of gas under pressure admitted as well as the volume of the active chamber, in which:

a) the intake valve is mounted so as to be axially displaceable between a low closed position, in which it bears sealingly on its valve seat, and a high open position, b) in the direction of its opening, the intake valve moves axially in its opening direction, the intake valve moves axially in the opposite direction to the flow of the gas under pressure stream filling the cylinder, c) in its closed position, the intake valve is held closed on its valve seat by the pressure prevailing in the intake duct and applying to the intake valve, d) the engine includes means for controlling the opening of the intake valve, substantially at top dead centre of the piston stroke, to cause the intake valve to lift off its seat to allow the build-up of intake pressure in the working chamber, the valve then travelling its full opening stroke under the action of the pressure differential forces exerted by the gas under pressure on the corresponding parts of the intake valve, e) the engine comprises a pneumatic actuator for closing the intake valve, which comprises a cylinder and a closing piston which is connected to the intake valve in an axially displaceable manner and which is mounted so as to be able to slide in the cylinder, inside which it delimits, in a sealed manner, a actuator pilot chamber, the so-called closing chamber, f) the engine comprises at least one channel for controlling the opening of the intake valve which connects the said intake chamber to a source of gas under pressure which is either the upper part of the active chamber of the cylinder, or the intake duct, g) the engine comprises an active distribution channel which connects the said closing chamber to the upper part of the active chamber and a valve for closing the flow of gas in the active distribution channel, known as the active distribution valve, the opening of which is controlled to put the closing chamber in communication with the upper part of the active chamber, to close the intake valve and to produce work which is added to the work of the charge of gas under pressure previously admitted, via the intake conduit, into the active chamber.

The contents of this document can be referred to for details of the other features of the engine.

The purpose of the invention is to propose a new design for such an active-chamber compressed-air engine aimed in particular at increasing its performance and efficiency, in particular by using a distribution system for controlling the opening and closing of the intake valve using a source of compressed gas—in particular compressed air—whose pressure value (known as low pressure) is lower than that of the pressure available in the high-pressure storage tank.

The "pneumatic" energy required to open and close the intake valve is, for example, fed in the form of gas from the high-pressure storage tank or from the intake circuit which is expanded to low pressure. After being used to control the opening of the valve, this energy can then be reused by producing additional work.

The volumes of the closing and/or opening chambers are small, for example but not limited to less than 10% of the engine displacement The same applies to the ducts connecting the intake and the active chamber, the intake and the closing chamber, the closing chamber and the expansion chamber are calculated to allow a sufficient flow rate to establish the pressures in the different active chambers.

The invention applies equally to the control of an exhaust valve.

SUMMARY OF THE INVENTION

The invention proposes an active chamber engine operating according to a three-phase thermodynamic cycle comprising:

an isobaric and isothermal transfer phase;

a polytropic expansion phase with work;

an exhaust phase at ambient pressure;

this engine comprising at least one cylinder fed with a gas under pressure, preferably compressed air, contained in a high-pressure storage tank, at least one piston which is slidably mounted in this cylinder, a crankshaft driven by the piston by means of a conventional connecting rod-crank device, a cylinder head which closes the volume of the cylinder, at its upper part, which is swept by the piston, and which comprises at least one intake duct into which flows a flow of gas under pressure for filling the cylinder an intake for the gas under pressure above the piston, and at least one exhaust orifice and one exhaust duct, the cylinder head being arranged in such a way that, when the piston is at its top dead centre, the residual volume contained between the piston and the cylinder head is, by construction, reduced to the minimum clearances allowing operation of the cylinder, at least one intake valve which cooperates in a sealing manner with a valve seat formed in the cylinder head and which delimits the intake orifice, wherein:

the volume of the cylinder swept by the piston is divided into two distinct parts, a first part of which constitutes an active chamber which is included in the cylinder and a second part of which constitutes an expansion chamber, under the continuous thrust of the gas under pressure admitted into the cylinder, at constant working pressure, the volume of the active chamber increases producing work corresponding to the isobaric and isothermal transfer phase of the thermodynamic cycle of operation, the admission of the gas under pressure into the cylinder is closed as soon as the maximum volume of the active chamber is reached, the quantity of gas under pressure contained in said active chamber then expanding by pushing back the piston over the second part of its stroke which determines the expansion chamber, producing work corresponding to the polytropic expansion phase of the thermodynamic operating cycle, the piston having reached its bottom dead centre, the exhaust orifice is then opened to carry out the exhaust phase of the thermodynamic operating cycle during the upstroke of the piston over its entire stroke to its top dead centre, the torque and the engine speed are controlled by opening and closing the intake valve, by opening the intake valve substantially at the top dead centre of the piston stroke, and by allowing the duration and/or the angular sector of the intake as well as the cross-sectional area of the intake opening to be varied by closing the valve in order, depending on the pressure of the gas under pressure in the storage tank and on the pressure at the end of the expansion phase, to determine the quantity of gas under pressure admitted as well as the volume of the working chamber, characterised in that:

a) the intake valve is mounted so as to be axially displaceable between a lower closed position, in which it bears in a sealed manner on its valve seat, and an upper open position, b) in its opening direction, the intake valve moves axially in the direction opposite to that of the flow of gas under pressure filling the cylinder, c) in its closed position, the intake valve is held closed on its seat by a return spring, d) the axial forces acting on the intake valve resulting from the pressure in the intake duct and in the cylinder are permanently balanced, e) the engine has a pneumatic actuator for controlling the opening of the intake valve, substantially at the top dead centre of the stroke of the piston, in order to cause the intake valve to lift off from its seat to allow the establishment of the intake pressure in the active chamber, the valve then travelling its full opening stroke against the force exerted by the return spring, f) the pneumatic actuator has an actuator cylinder and a piston which is connected to the intake valve and which delimits a pilot chamber which is connected to a source of low-pressure gas, g) the engine has a channel which connects the source of low-pressure gas to the pilot chamber, and a controlled valve for admitting low pressure gas into the pilot chamber, i) the engine has a channel for controlling the closing of the intake valve which connects the pilot chamber to the open air or to an energy recovery system, and a controlled valve for emptying the pilot chamber.

According to other features of the invention:

the low-pressure gas source is a pressure reducer, the intake of which is connected to the high-pressure storage tank or to the intake duct, and the outlet of which is connected to the pilot chamber;

the pressure reducer is a variable outlet pressure reducer controlled to vary the amount of lift of the intake valve from its seat;

the engine comprises an energy recovery system, a channel which connects the energy recovery system to the upper part of the cylinder situated above the piston, and a controlled valve for actively emptying the energy recovery system into the upper part of the cylinder;

the intake, emptying and active emptying valves are controlled along the following cycle:

i) opening the inlet valve to put the pilot chamber in communication with the source of low pressure gas and causing the intake valve to open at about the top dead centre of the piston to put the intake duct in communication with the active chamber of the cylinder, ii) closing the inlet valve and opening the outlet valve when the piston reaches the required limit of the active chamber to cause a drop in pressure in the pilot chamber and to cause the intake valve to close, iii) closing of the valve and, when the pressure in the cylinder is lower than or equal to the pressure in the energy recovery system, opening the active drain valve to introduce into the cylinder a charge which is added to the charge previously admitted into the active chamber, iv) closing the active drain valve when the piston moves up;

the pneumatic actuator for controlling the opening of the intake valve is integrated into the cylinder head and its piston is integral with the rod of the intake valve;

the pneumatic actuator for controlling the opening of the intake valve is arranged outside the cylinder head, and in that the output member of the cylinder is connected directly or indirectly to the stem of the intake valve via a movement transmission member;

the pneumatic actuator for controlling the opening of the intake valve is a pneumatic muscle, and in that the said movement-transmitting member is a rocker which is mounted so as to pivot about an axis which is orthogonal to the sliding axis of the intake valve, one of the ends of which is connected one end of which is connected, directly or indirectly, to the stem of the intake valve, and the other opposite end is connected to the output member of the pneumatic control actuator;

the position of the pivot pin of the rocker is adjustable between its two opposite ends;

the stem of the intake valve is traversed axially by a pressure balancing channel which opens into a compensation chamber and into the upper part of the cylinder.

BRIEF DESCRIPTION OF THE FIGURES

Further features and advantages of the invention will become apparent from the following detailed description, for the understanding of which reference is made to the annexed drawings in which.

DETAILED DESCRIPTION OF THE INVENTION

Figure 1A:
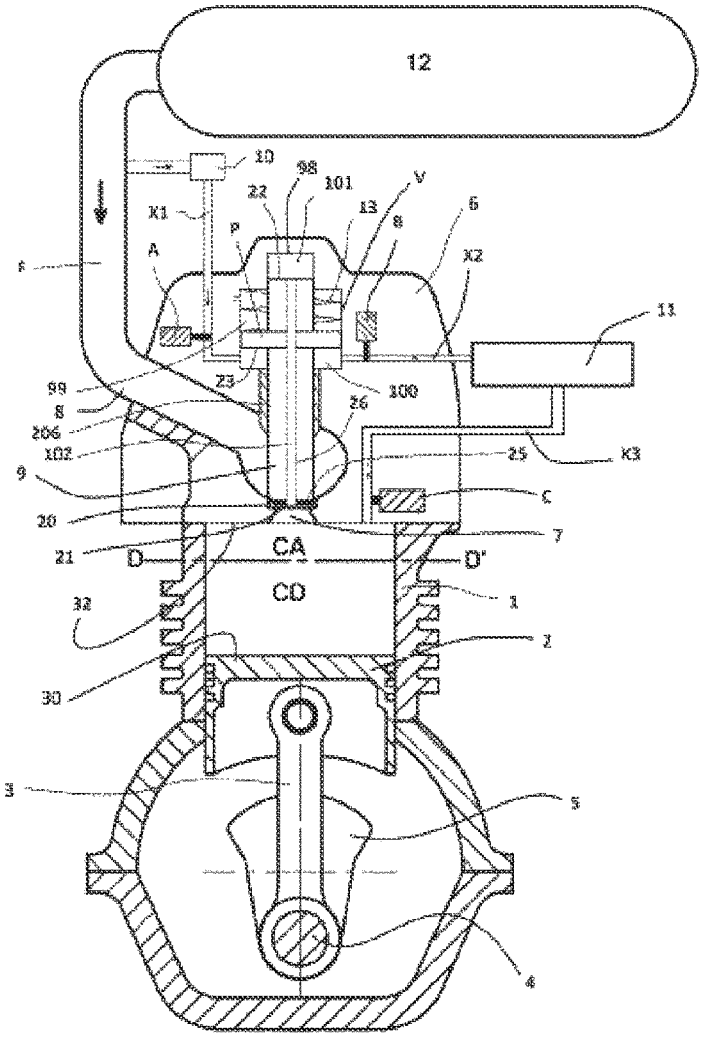
FIG. 1A schematically represents a first mode of implementation of an engine according to the invention, with an active chamber included in the cylinder, which is illustrated in axial section at its bottom dead centre, and its compressed air feeding device.

The engine has one or more cylinders, of which only one is shown 1, which is fed with a gas under pressure, preferably compressed air, contained in a high pressure storage tank 12.

The engine has a piston 2 which is mounted axially slidably in the cylinder 1, and a crankshaft 5 which is driven by the piston 2 by means of a conventional connecting rod 3 and crank 4 device.

The engine has a cylinder head 6 which closes off the internal volume of the cylinder 1 at the top, which is swept by the piston 2.

The internal volume of the cylinder 1 which is swept by the piston 2 is divided along an imaginary line DD' (corresponding to a dividing plane orthogonal to the axis of the cylinder 1) into two parts or chambers comprising:

a first upper part constituting the active chamber CA, which is thus included in the cylinder 1;

and a second lower part constituting the expansion chamber CD.

The cylinder head 6 has at least one intake duct 8 which is connected to the tank 12 and into which the gas under pressure flow from the cylinder 1 flows.

The intake duct 8 terminates at its lower end in a gas under pressure intake 7 arranged above the piston 2.

The cylinder head 6 and the piston 2 are arranged in such a way that, when the piston 2 is at its top dead centre, the residual volume between the piston 2 and the cylinder head 6 is, by construction, reduced to the minimum clearance allowing non-contact operation between the piston 2 and the cylinder head 6, i.e. without contact between the upper face 30 of the piston 2 and the portion opposite the lower face 32 of the cylinder head 6 which closes the cylinder 1 at its top.

In order to open or close the intake orifice 7, the cylinder head 6 has an intake valve 9, which is, in particular, able to cooperate in a sealing manner with a valve seat 20 formed in the cylinder head 6 and delimiting the intake orifice 7.

The cylinder head 6 also has at least one exhaust valve, at least one exhaust orifice and at least one exhaust duct (not shown) and is similar in design and operation to the intake system described in detail herein.

In such an engine in which the volume of the cylinder 1 swept by the piston 2 is divided into a so-called active chamber CA which is included in the cylinder 1, and a second part constituting an expansion chamber CD:

a) under the continuous thrust of the gas under pressure admitted into cylinder 1, at constant working pressure, the volume of the active chamber CA increases, producing work corresponding to the first quasi-isothermal transfer phase of the thermodynamic operating cycle;

b) the gas under pressure is admitted to the cylinder 1 and is shut off as soon as a selected maximum volume of the active chamber CA is reached, the quantity of gas under pressure in the active chamber CA then expanding by pushing the piston 2 over the second part of its downward stroke, which determines the volume of the expansion chamber CD, producing work corresponding to the second expansion phase of the thermodynamic cycle of operation;

c) when piston 2 has reached its bottom dead centre (BDC), the exhaust orifice is opened by control of the exhaust valve in order to—during the upstroke of piston 2 over its entire stroke to its top dead centre (TDC)—carry out the third exhaust phase of the thermodynamic cycle of operation.

The torque supplied by the engine is controlled by opening and closing the intake valve 9 by opening it at the top dead centre TDC of the piston stroke 2 and closing it again to modify the duration and/or the angular sector of the intake, as well as the cross-section of the intake opening, in particular as a function of the value of the pressure of the gas contained in the storage tank 12. In this way, the amount of gas under pressure which is admitted into the cylinder and the volume of the active chamber CA is determined.

Figure 1B:
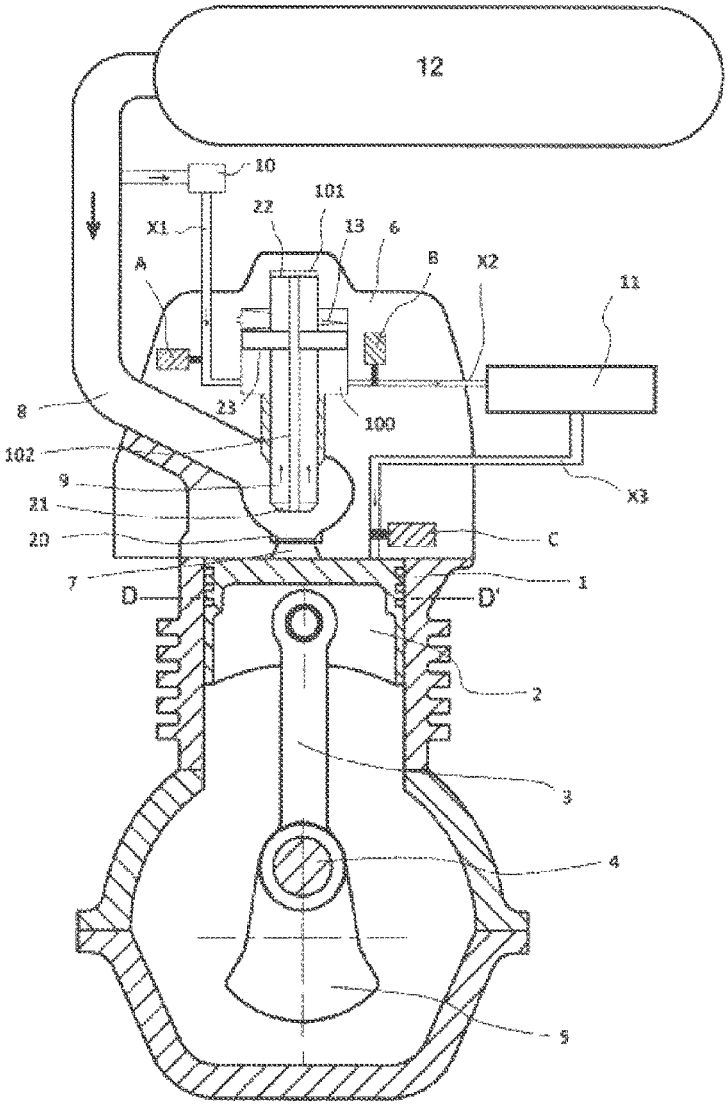
FIG. 1B is a similar view to FIG. 1A in which the engine is shown being admitted at top dead centre with the intake valve open from top dead centre.

The intake duct 8 is directly connected to the high-pressure gas tank 12 which thus directly supplies the active chamber CA, the latter being at the same pressure as that of the gas contained in the tank 12, for example of the order of 100 bar, and higher than that prevailing in the active chamber CA and the expansion chamber CD, for example equal to 1.5 bar at the time of the cycle corresponding to the bottom dead centre PMB of the piston, at the end of the expansion, just before the opening of the exhaust valve The intake valve 9 is slidably guided in a valve guide 206 and is mounted for axial displacement—along its main axis—between:

a low closed or shut-off position (considering the general vertical orientation of the figures and without reference to the earth's gravity) which is represented in FIG. 1A and in which the lower part or head 25 of the valve is in sealed abutment on the valve seat 20; and a high open position represented in FIG. 1B.

In the direction of its opening, the intake valve 9 moves axially—upwards—in the opposite direction to the flow of the gas under pressure stream F filling the cylinder. Thus, the intake valve opens in the opposite direction to the flow of pressurised air filling the engine cylinder.

Figure 1C:
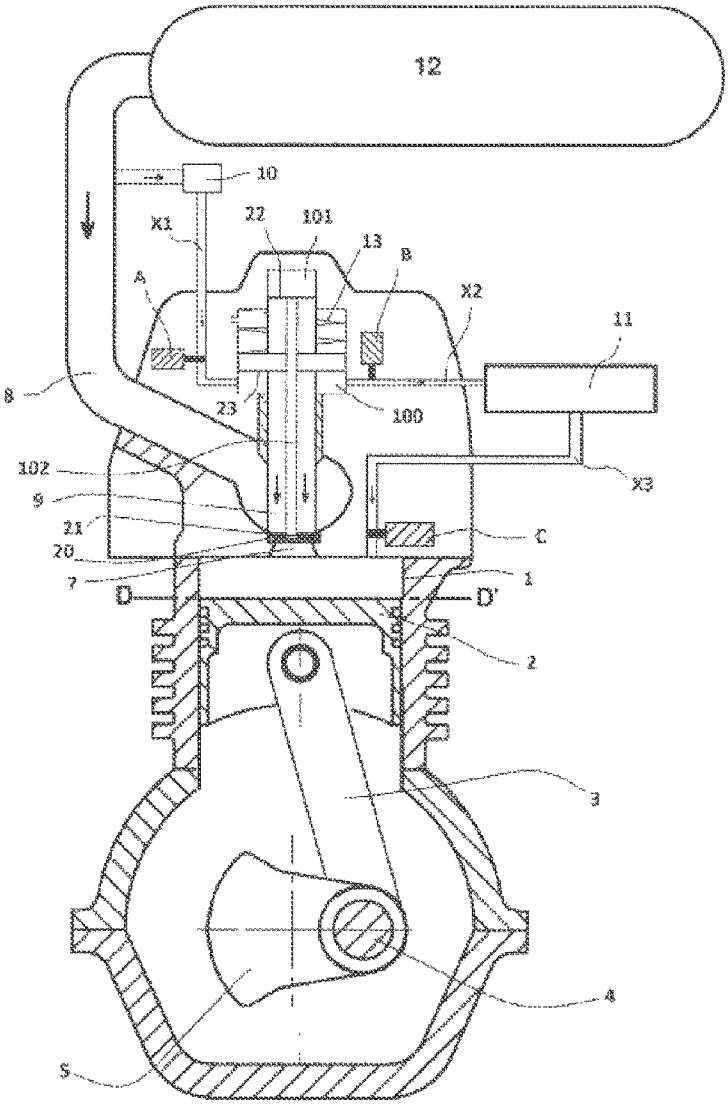
FIG. 1C is a similar view to FIGS. 1A and 1B in which the engine is shown in the expansion phase.

The engine has a pneumatic actuator, or gas actuator, V for controlling the opening of the intake valve 9, which, by way of non-limiting example and according to the design illustrated in FIGS. 1A to 1C, is arranged in the cylinder head 6.

The actuator V comprises an actuator cylinder and a closing piston P, which is axially displaceably connected to the upper rod 26 of the intake valve 9, and which is slidably mounted in the actuator cylinder of the actuator V, inside which it sealingly delimits a lower chamber 100, called the opening chamber of the intake valve 9, or pilot chamber.

Above the piston P, the cylinder has an upper chamber 99 in which a spring 13 for the elastic return of the intake valve 9 is accommodated, which is, for example, a helical spring that is compressed in the upper chamber 99 and exerts a downwardly directed elastic force on the upper side 27 of the piston P.

Above the upper chamber 99 housing the return spring 13, the cylinder extends into an upper section 98 of smaller diameter in which the upper part of the intake valve stem 26—which extends above the piston P—is axially slidably received.

The upper free end face 22 of the stem 26 of the intake valve 9 delimits in the section 98 an upper chamber 101 called compensation chamber.

The compensation chamber 101, also known as the pressure equalization chamber, is permanently connected to the upper part of the cylinder 1 located above the piston 2 by a central channel 102 opening at both opposite ends, which extends axially through the valve 9 over its entire height.

A channel X1 connects the intake duct 8 to the lower compensation chamber 100 of the cylinder V.

The engine has a controlled inlet valve A, which is arranged in the channel X1, and whose opening can be controlled to bring the intake duct 8 and/or the tank 12 into communication with the compensation chamber 100.

A pressure reducer 10 is interposed in the channel X1, here preferably upstream of the inlet valve A, to reduce the pressure at the outlet of the pressure reducer 10 to a so-called low pressure value of the order of a few bars—for example equal to 8 bars—in order to feed the compensation chamber 100.

The pressure reducer 10 may have a constant output pressure or alternatively an adjustable output pressure.

When the outlet pressure of the valve is adjustable, the control of its value allows the value of the valve lift to be varied.

The lower compensation chamber 100 is here connected to the upper part of the cylinder 1 located above the piston 2 by two consecutive channels X2 and X3 with the interposition of an energy recovery system 11.

The engine has a controlled valve B, the so-called shut-off drain valve B, arranged in the channel X2, which can be controlled to open the compensation chamber 100 in communication with the potential energy recovery system 11.

The engine has a controlled valve C, the so-called active drain valve, which connects the upper part of the cylinder 1 to the potential energy recovery system 11 and which can be controlled to open to bring the potential energy recovery system 11 together with the cylinder 1.

The intake valve 9 is permanently biased towards its closed position. For example, the intake valve 9 is resiliently biased and is held closed on its valve seat 20 by a return spring 13.

The design of the intake valve 9 is such that it is balanced against the pressure forces in the cylinder 1, which are applied to the lower side 21 of the valve head 25.

This is achieved by the presence of the upper compensation chamber 101 which is connected to the upper part of the cylinder 1 by the channel 102.

It is thus noted that the value of the pressure in the compensation chamber 101 is always equal to the value of the pressure in the cylinder 1.

The surface area of the upper free end face 22 of the stem 26 of the intake valve 9 which is equivalent to the surface area of the lower face 21 of the head 25 of the intake valve 9 which is subjected to the same value of pressure, thereby allowing the effects on the valve resulting from the pressure to be cancelled out.

The engine has a so-called low-pressure distribution system which is connected to the intake duct 8 by the pressure reducer 10 whose output pressure value is lower than the pressure of the high-pressure gas contained in the tank 12.

The maximum value of the pressure in the distribution system downstream of the pressure reducer 10 is constant throughout the progressive emptying of the tank 12.

This maximum value of the pressure in the valve system corresponds at least to the achievement of a full lift of the valve 9, but it can vary below this maximum value in order to decrease the stroke of the intake valve 9.

When the piston 2 approaches the top dead centre of its stroke, the so-called inlet valve A opens the channel X1 to pressurise the pilot chamber 100 by connecting it to the outlet of the pressure reducer 10.

The pilot pressure is then applied to the lower surface 23 of the piston P, which is attached to the valve stem 9.

The force thus applied to the intake valve 9 is greater than the downward return force exerted by the spring 13 on the upper face 27 of the piston P, and it causes the valve 9 to lift off the seat 20.

The valve 9 then travels through its full opening stroke and connects the intake duct 8 to the cylinder 1.

Only the force exerted by the spring 13 on the one hand and the pressure force exerted on the face 23 on the other hand act on the valve 9.

When the piston 2 reaches the point of its axial stroke corresponding to the delimitation of the active chamber DD' (whose axial position is a function of the required torque), the inlet valve A is closed and the outlet valve B is opened to cause the gas to expand to a pressure value lower than the pilot pressure prevailing in the pilot chamber 100

The decrease in the value of the gas pressure applied to the lower face 23 of the piston P and the value of the return force permanently exerted by the return spring 13 then cause the intake valve 9 to descend until its head 25 is in tight contact with the valve seat 20.

Controlling the opening of the drain valve B puts the pilot chamber 100 in communication with the potential energy recovery system 11.

With the intake valve 9 closed, the compressed gas in the cylinder 1 expands as the piston 2 descends and its value decreases.

When the value of the pressure in the cylinder 1 is lower than or equal to the value of the pressure in the potential energy recovery system 11, the closing of the drain valve B is controlled, and the opening of the active drain valve C is controlled in turn to—through the channel X3—put the potential energy recovery system 11 in communication with the cylinder 1.

The design of the potential energy recovery system 11 can take several forms, depending on the type of energy to be recovered, and for example:

- in the form of a potential energy recovery system, the purpose of which is to reinject into the cylinder 1 the gas under pressure used in the active distribution system in order to produce additional mechanical work by means of the piston 2—according to the mode of implementation illustrated in the figures; or
- alternatively, the form of a potential and kinetic energy recovery system through a turbine system (not shown); or
- alternatively, in the form of a thermal energy recovery system (not shown).

A combination of one or more of these energy recovery systems can be considered.

In the first case illustrated in the figures, the volume of gas recovered and accumulated in a capacity 11 is injected into the cylinder 1 by expanding in the expansion chamber CD of the engine, producing work which is added to the expansion work of the charge admitted into the active chamber CA. Thus, in the sense of the invention, the valve C is an active distribution valve.

The operation of the so-called active valve according to the invention is therefore understood, in which, advantageously, the energy required to control the opening and closing of the intake valve 9 is reused in whole or in part, in various possible forms.

The exhaust valve and exhaust duct are not shown in FIGS. 1A to 6, but the assembly operates on the same principle as that governing the intake.

The exhaust valve control system can be connected to the same pressure reducer 10 and the same potential energy recovery system 11 as those belonging to the intake valve control system 9. The opening cycle of the exhaust valve is close to an opening at the bottom dead centre of the piston stroke 2 and close to a closing at the top dead centre of the piston stroke 2.

Description of the Second Embodiment

The following description is made by comparison with the first embodiment previously described with reference to FIGS. 1A to 1C.

Figure 2:
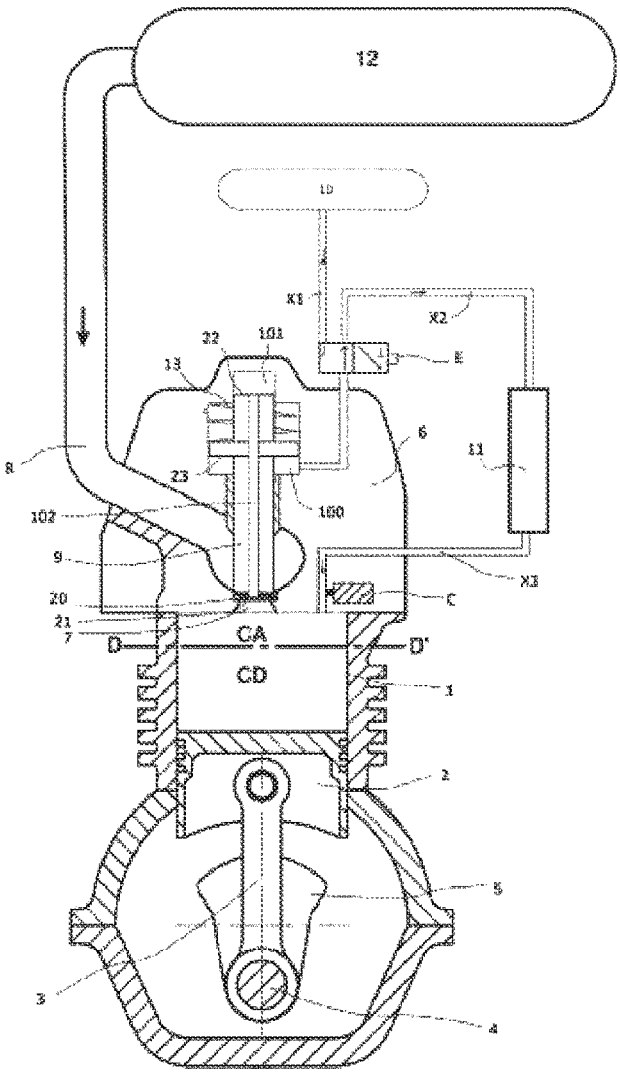
FIG. 2 is a view similar to FIG. 1A which illustrates a second embodiment of an engine according to the invention.

In the design according to this second embodiment shown in FIG. 2, the two valves A and B shown in FIGS. 1A to 1C are replaced by a spool valve E, commonly known as a distributor.

The E-valve is a two-position, three-way type.

In its state or position illustrated in the figure, the pilot chamber 100 is connected to the channel X2 upstream of the potential energy recovery system 11.

A change in the position of the valve spool causes the outlet of the valve 10 to communicate with the pilot chamber 100 and the communication between the pilot chamber 100 and the channel X2 to be interrupted.

Description of the Third Embodiment

The following description is made by comparison with the first embodiment previously described with reference to FIGS. 1A to 1C.

Figure 3:
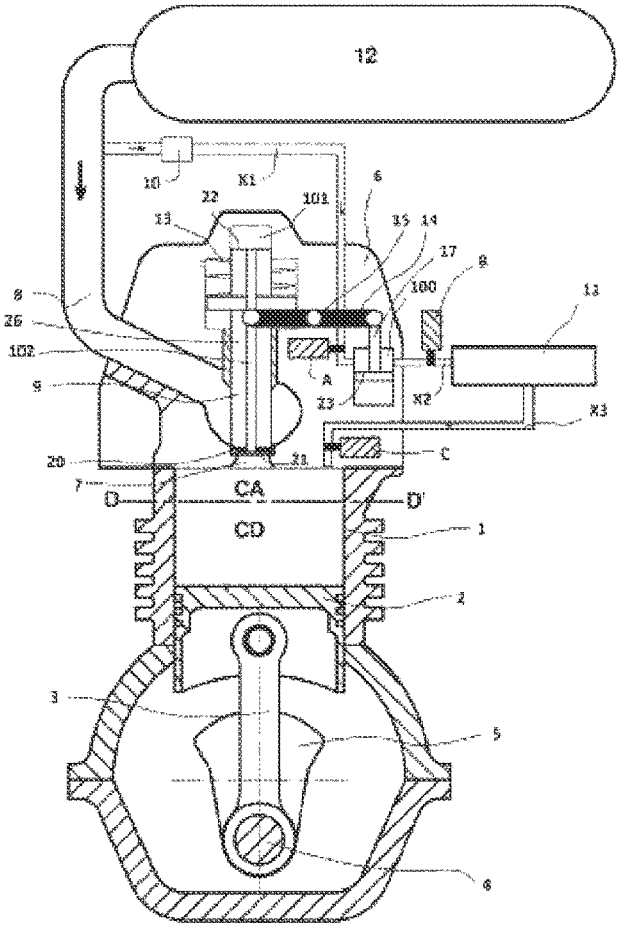
FIG. 3 is a view similar to that of FIG. 1A which illustrates a third embodiment of an engine according to the invention.

In the design according to this third embodiment shown in FIG. 3, the possibility of misaligning the pilot chamber with respect to the valve 9 is emphasised by means of a rocker 14 mechanically connecting the intake valve 9 to a pneumatic actuator V containing the pilot chamber 100.

The cylinder V is laterally offset and can be arranged outside the cylinder head 6 as an independent discrete component.

This design makes it easier to size the V-cylinder and the pilot chamber.

It also facilitates manufacturing and maintenance, and limits the inconveniences due to possible leaks at the piston P of the cylinder V illustrated in the first embodiment.

As a non-limiting example, an actuator V for controlling the opening of the valve can be of the so-called "pneumatic muscle" type, whose force/stroke behaviour is almost linear and whose stroke is directly adjustable by setting the value of its feed pressure.

Such a cylinder can be used with a low feed pressure of, for example, 8 bar or less.

This type of pneumatic muscle (Fluidic Muscle DMSP) is for example marketed under the registered trademark "FESTO".

The rocker 14 is pivotally mounted about an axis 15 which is orthogonal to the sliding axis of the intake valve 9. One of its ends is connected directly or indirectly to the valve stem 26, and its other opposite end is connected to the output member 17 of the offset cylinder V.

Figure 4:
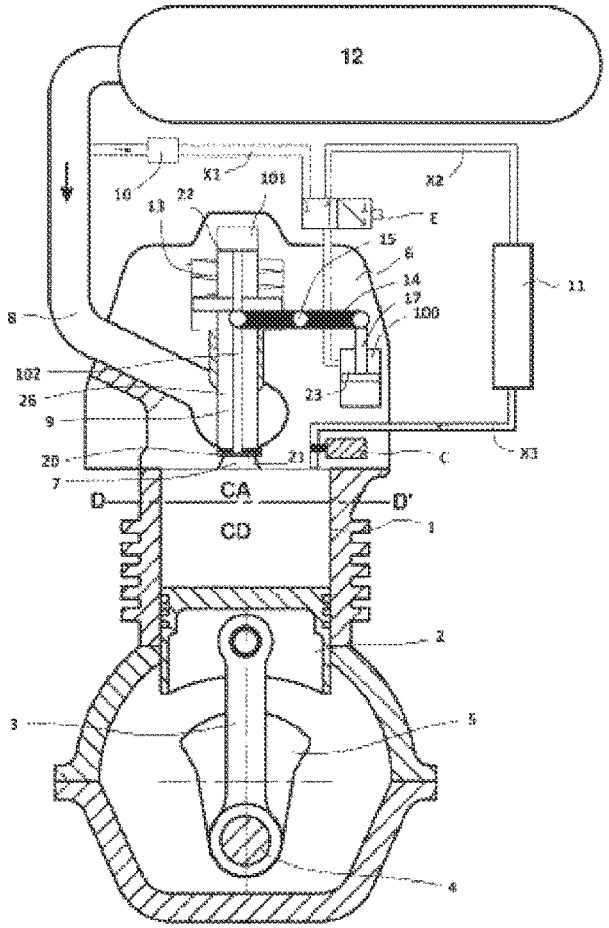
FIG. 4 is a view similar to FIG. 3 which illustrates an alternative variant of the third embodiment.

According to a first variant and as illustrated in FIG. 4, the two valves A and B of FIG. 3 can be replaced by a spool valve E.

Figure 5:
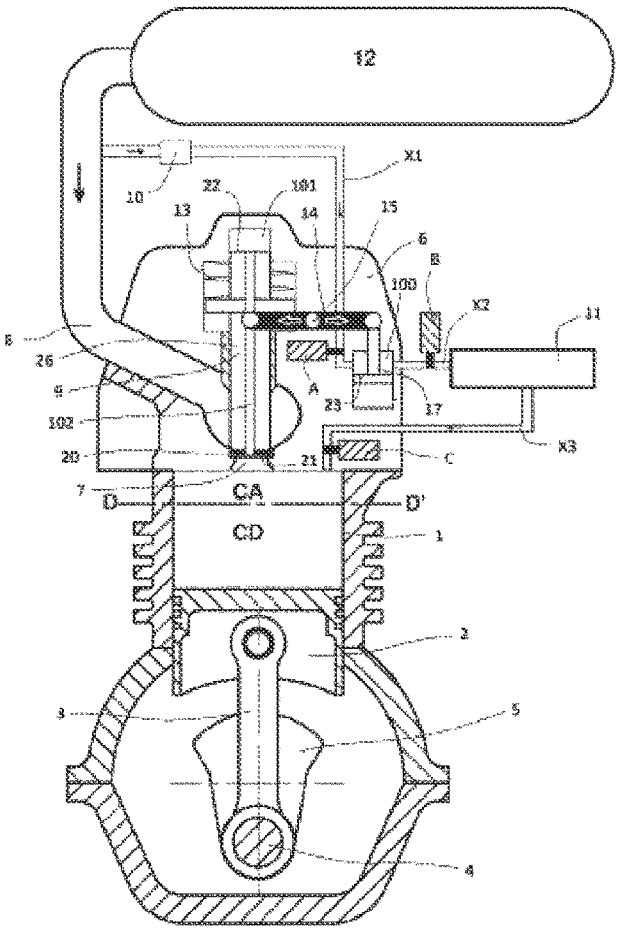
FIG. 5 is a view similar to FIG. 3 which illustrates another variant of the third embodiment.

According to another variant and as illustrated in FIG. 5, and in comparison with the previously described embodiment with reference to FIG. 3, the possibility of adjusting the position of the pivot pin 15 of the rocker 14 and thus varying the stroke of the valve 9 according to the different phases of operation of the engine is shown.

Description of a Cartridge Incorporating a Valve

Figure 6:
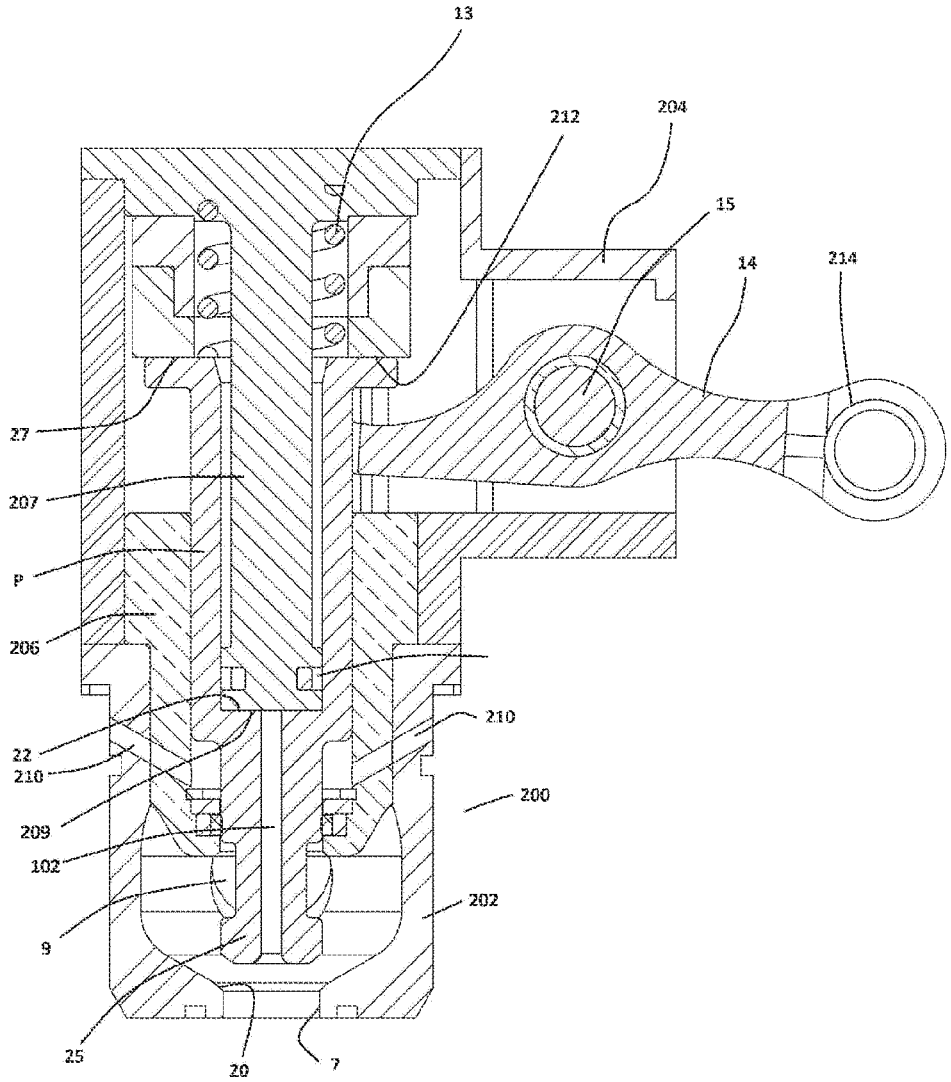
FIG. 6 is an axial cross-sectional view of an example of a modular cartridge incorporating a valve suitable for integration into an engine of the type illustrated schematically in FIGS. 3 and 4.

FIG. 6 shows a cartridge 200 having a housing with two lower 202 and upper 204 parts which house an external valve guide 206 which slidably guides the stem 26 of a valve 9 whose lower head 25 is shown facing a valve seat 20 integral with the lower 202 part of the cartridge 200 housing.

The intake 7 is formed in the lower part 202 of the cartridge housing and is cylindrical in cross section The upper section of the rod 25 is shaped as a hollow piston P in which an internal valve guide 207 is sealingly received.

In the sense of the invention, the compensation chamber 101 is thus arranged at the interface between the upper face 22 of the rod 25—into which the balancing channel 102 opens—and the facing lower face portion 209 of the internal guide 207.

The outer guide 206 and the lower part 202 of the housing have venting passages 210 passing through them.

In FIG. 6, the valve 9 is shown in its highest position corresponding to the command to open it fully.

This position is determined by a mechanical stop surface 212 carried by the upper part 204 of the housing against which the upper face 27 is axially supported upwards.

The hollow piston P integral with the rod 25 is capable of being driven axially sliding in both directions—between its upper position illustrated in FIG. 6 and its lower position in which the head 25 is bearing axially downwards against the seat 20 (see FIG. 7)—by a rocker 14 which is mounted so as to pivot about a fixed axis 15 carried by the upper part 204 of the cartridge housing 200.

Figure 7:
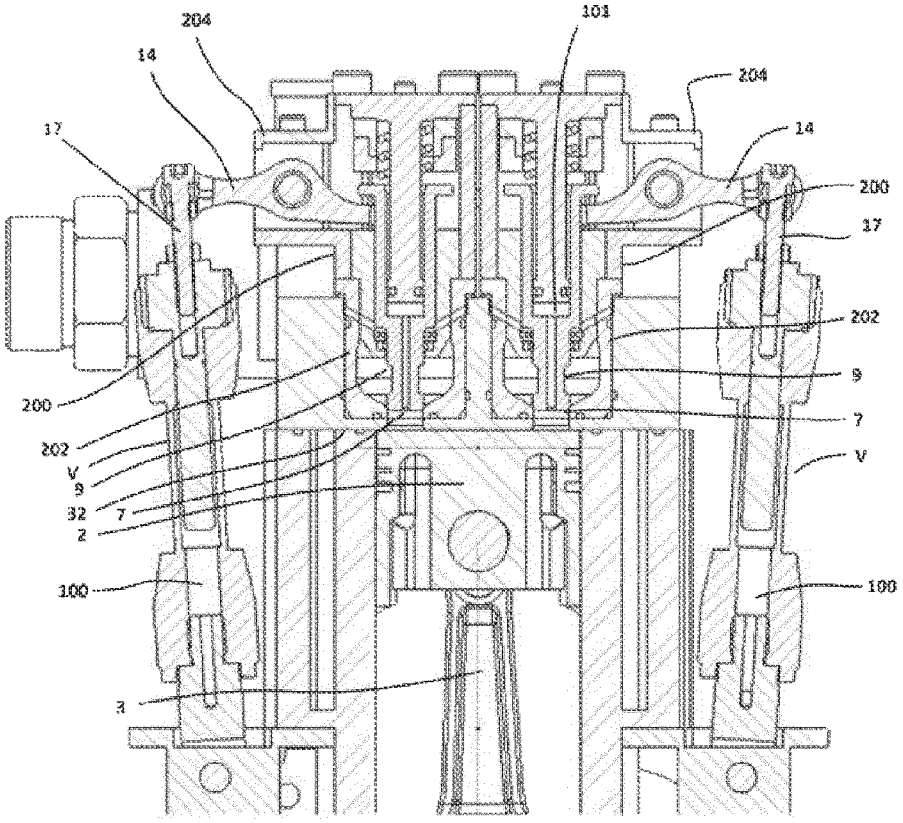
FIG. 7 is a cross-sectional view through a plane passing through the axes of an intake valve and an exhaust valve of an example embodiment of an engine of the type illustrated schematically in FIGS. 3 and 4 in which each valve is integrated with a cartridge as illustrated in FIG. 6.

The free end 214 of the rocker 14 is adapted to be hingedly connected to the output rod of a control actuator or cylinder which is, for example, a pneumatic muscle as shown in FIG. 7.

Description of FIG. 7 Incorporating an "Intake" Cartridge and an "Exhaust" Cartridge In FIG. 7, which is generally symmetrical with respect to a vertical median plane, an intake cartridge 200 is shown on the left-hand side and an exhaust cartridge 200' on the right-hand side, all the components of which are designated by the same numerical references increased by the subscript "prime".

Figure 8:
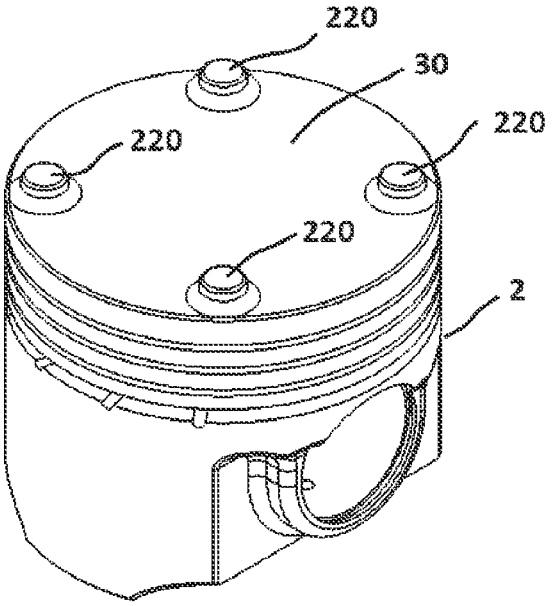
FIG. 8 is a top perspective view of an example of a piston design particularly suited to the design of an engine according to the invention.

Description of the Piston in FIG. 8

In accordance with the invention, the cylinder head 6 is designed and arranged in such a way that, when the piston 2 is at its top dead centre, the residual volume between the piston 2 and the cylinder head 6 is, by design, reduced to the minimum clearances that allow non-contact operation between the piston 2 and the cylinder head 6.

FIG. 8 shows an example of a piston design 2 that is particularly suitable for achieving this result.

To this end, the upper face 30 of the piston is a flat face which extends in a plane orthogonal to the sliding axis of the piston and—when the piston 2 is at its top dead centre TDC corresponding to zero degrees of angle of the crankshaft—this upper face is thus able to be adjacent, almost without axial play, to the lower face 32 facing the cylinder head 6.

In order to "fill" each dead volume corresponding to each intake 7 (or outlet 7'), the upper face 30 has as many protruding pins or fingers 220 (220'), each of which is sized (in diameter and height) to be received in an intake 7 (7').

The example shown in FIG. 8 has two fingers 220 for two intake ports and two fingers 220' for two outlet ports 7'.

The invention claimed is:

1. An active chamber engine operating according to a three-phase thermodynamic cycle comprising:

an isobaric and isothermal transfer phase;

a polytropic expansion phase with work;

an exhaust phase at ambient pressure;

the engine comprising at least one cylinder fed with a gas under pressure contained in a high-pressure storage tank, at least one piston which is slidably mounted in the cylinder, a crankshaft driven by the piston by means of a conventional connecting rod-crank device, a cylinder head which closes the volume of the cylinder, at the cylinder's upper part, which is swept by the piston, and which comprises at least one intake duct into which flows a flow of gas under pressure for filling the cylinder an intake for the gas under pressure above the piston, and at least one exhaust orifice and one exhaust duct, the cylinder head being arranged in such a way that, when the piston is at top dead centre, a residual volume contained between the piston and the cylinder head is, by construction, reduced to minimum clearances allowing operation of the cylinder, at least one intake valve which cooperates in a sealing manner with a valve seat formed in the cylinder head and which delimits an intake orifice, wherein:

the volume of the cylinder swept by the piston is divided into two distinct parts, a first part of which constitutes an active chamber which is included in the cylinder and a second part of which constitutes an expansion chamber, under the continuous thrust of the gas under pressure admitted into the cylinder, at constant working pressure, the volume of the active chamber increases producing work corresponding to the isobaric and isothermal transfer phase of a thermodynamic cycle of operation, the admission of the gas under pressure into the cylinder is closed as soon as the maximum volume of the active chamber is reached, the quantity of the gas under pressure contained in said active chamber then expanding by pushing back the piston over the second part of the piston's stroke which determines the expansion chamber, producing work corresponding to the polytropic expansion phase of the thermodynamic cycle of operation, the piston having reached bottom dead centre, the exhaust orifice is then opened to carry out the exhaust phase of the thermodynamic operating cycle during the upstroke of the piston over the piston's entire stroke to top dead centre, a torque and an engine speed are controlled by opening and closing the intake valve, by opening the intake valve at the top dead centre of the piston stroke, and by allowing a duration and/or an angular sector of the intake as well as a cross-sectional area of an intake opening to be varied by closing the intake valve in order, depending on the pressure of the gas under pressure in the storage tank and on the pressure at the end of the expansion phase, to determine the quantity of gas under pressure admitted as well as the volume of a working chamber, wherein:

a) the intake valve is mounted so as to be axially displaceable between a lower closed position, in which the intake valve bears in a sealed manner on the intake valve's valve seat, and an upper open position, b) in the intake valve's opening direction, the intake valve moves axially in the direction opposite to that of the flow of gas under pressure filling the cylinder, c) in the intake valve's closed position, the intake valve is held closed on the intake valve's seat by a return spring, d) the axial forces acting on the intake valve resulting from the pressure in the intake duct and in the cylinder are permanently balanced, e) the engine has a pneumatic actuator for controlling the opening of the intake valve, at the top dead centre of the stroke of the piston, in order to cause the intake valve to lift off from the intake valve's seat to allow the establishment of the intake pressure in the active chamber, the intake valve then travelling a full opening stroke against the force exerted by the return spring, f) the pneumatic actuator has an actuator cylinder and an actuator piston which is connected to the intake valve and which delimits a pilot chamber which is connected to a low-pressure gas source, g) the engine has a channel which connects the low-pressure gas source to the pilot chamber, and a first controlled valve for admitting low pressure gas into the pilot chamber, i) the engine has a channel for controlling the closing of the intake valve which connects the pilot chamber to the open air or to an energy recovery system, and a second controlled valve for emptying the pilot chamber, and wherein the low-pressure gas source is a pressure reducer, an intake of which is connected to the high-pressure storage tank or to the intake duct, and an outlet of which is connected to the pilot chamber.

2. The active chamber engine as claimed in claim 1, wherein the pressure reducer is a variable outlet pressure reducer controlled to vary the amount of lift of the intake valve from the intake valve's seat.

3. The active chamber engine according to claim 2, wherein a channel which connects the energy recovery system to the upper part of the cylinder situated above the piston slidably mounted in the cylinder, and a third controlled valve for actively emptying the energy recovery system into the upper part of the cylinder.

4. The active chamber engine according to claim 2, wherein a stem of the intake valve is traversed axially by a pressure balancing channel which opens into a compensation chamber and into the upper part of the cylinder.

5. The active chamber engine according to claim 1, wherein a channel which connects the energy recovery system to the upper part of the cylinder situated above the piston slidably mounted in the cylinder, and a third controlled valve for actively emptying the energy recovery system into the upper part of the cylinder.

6. The active chamber engine as claimed in claim 5, wherein the first controlled valve for admitting low pressure gas into the pilot chamber, the second controlled valve for emptying the pilot chamber, and the third controlled valve for actively emptying the energy recovery system are controlled along the following cycle:

i) opening the first controlled valve for admitting low pressure gas into the pilot chamber to put the pilot chamber in communication with the low-pressure gas source and causing the first controlled valve for admitting low pressure gas into the pilot chamber to open at about the top dead centre of the piston to put the intake duct in communication with the active chamber of the cylinder, ii) closing the first controlled valve for admitting low pressure gas into the pilot chamber and opening the second controlled valve for emptying the pilot chamber when the piston reaches the required limit of the active chamber to cause a drop in pressure in the pilot chamber and to cause the intake valve to close, iii) closing the second controlled valve for emptying the pilot chamber when the pressure in the cylinder is lower than or equal to the pressure in the energy recovery system, opening the third controlled valve for actively emptying the energy recovery system to introduce into the cylinder a charge which is added to the charge previously admitted into the active chamber, iv) closing the third controlled valve for actively emptying the energy recovery system when the piston moves up.

7. The active chamber engine according to claim 6, wherein a stem of the intake valve is traversed axially by a pressure balancing channel which opens into a compensation chamber and into the upper part of the cylinder.

8. The active chamber engine according to claim 5, wherein a stem of the intake valve is traversed axially by a pressure balancing channel which opens into a compensation chamber and into the upper part of the cylinder.

9. The active chamber engine according to claim 1, wherein the pneumatic actuator for controlling the opening of the intake valve is integrated into the cylinder head and the piston is integral with a rod of the intake valve.

10. The active chamber engine according to claim 9, wherein a stem of the intake valve is traversed axially by a pressure balancing channel which opens into a compensation chamber and into the upper part of the cylinder.

11. The active chamber engine according to claim 1, wherein the pneumatic actuator for controlling the opening of the intake valve is arranged outside the cylinder head, and wherein an output member is connected directly or indirectly to a stem of the intake valve via a movement transmission member.

12. The active chamber engine according to claim 11, wherein the pneumatic actuator for controlling opening of the intake valve is a pneumatic muscle, and wherein the said movement transmission member is a rocker which is mounted so as to pivot about an axis which is orthogonal to the sliding axis of the intake valve, one of two opposite ends of which is connected, directly or indirectly, to the stem of the intake valve, and the other of the two opposite ends of which is connected to the output member of the pneumatic actuator.

13. The active chamber engine as claimed in claim 12, wherein a position of a pivot pin of the rocker is adjustable between said two opposite ends.

14. The active chamber engine according to claim 13, wherein the stem of the intake valve is traversed axially by a pressure balancing channel which opens into a compensation chamber and into the upper part of the cylinder.

15. The active chamber engine according to claim 12, wherein the stem of the intake valve is traversed axially by a pressure balancing channel which opens into a compensation chamber and into the upper part of the cylinder.

16. The active chamber engine according to claim 11, wherein the stem of the intake valve is traversed axially by a pressure balancing channel which opens into a compensation chamber and into the upper part of the cylinder.

17. The active chamber engine according to claim 1, wherein a stem of the intake valve is traversed axially by a pressure balancing channel which opens into a compensation chamber and into the upper part of the cylinder.

* * * * *